United States Patent [19]

Suwa et al.

[11] 4,290,555

[45] Sep. 22, 1981

[54] METHOD FOR SUPPLYING POWDER TO BE USED IN HOME SPRAY COATING OPERATION

[75] Inventors: Toshio Suwa, Tokyo; Yoshiaki Konagaya, Yokohama; Hiroshi Ishii, Tokyo, all of Japan

[73] Assignee: Nippon Sanso K. K., Minato, Japan

[21] Appl. No.: 122,065

[22] Filed: Feb. 15, 1980

[30] Foreign Application Priority Data

Feb. 21, 1979 [JP] Japan ..... 54-19444

[51] Int. Cl.[3] ..... B05D 1/10

[52] U.S. Cl. ..... 239/8; 239/85; 239/124; 406/144; 427/423

[58] Field of Search ..... 427/423; 118/300; 239/8, 85, 124, 325; 406/144, 153, 105

[56] References Cited

U.S. PATENT DOCUMENTS

| | | | |
|---|---|---|---|
| 2,786,779 | 3/1957 | Long et al. | 239/85 X |
| 2,861,900 | 11/1958 | Smith et al. | 427/423 |
| 3,205,016 | 9/1965 | Panning | 406/105 |
| 3,285,670 | 11/1966 | Hubbard | 406/105 |
| 3,295,895 | 1/1967 | Latham | 406/144 X |
| 3,425,601 | 2/1969 | Fry | 406/144 X |
| 3,442,454 | 5/1969 | Stenger et al. | 239/85 X |
| 4,019,783 | 4/1977 | Kayser | 406/144 |
| 4,186,772 | 2/1980 | Handleman | 406/153 X |

*Primary Examiner*—Shrive P. Beck

*Attorney, Agent, or Firm*—Kane, Dalsimer, Kane, Sullivan and Kurucz

[57] ABSTRACT

A method for supplying raw powder material such as metal, intermetallic compound or ceramics to a spray coating burner wherein fuel gas or auxiliary combustion gas or their mixed gas is used as jet gas, any one of these gases is introduced under control of the flow rate thereof into a suction chamber of an ejector to serve as suction gas whereby the supply amount of said raw powder material to be fed to said spray coating burner can be controlled.

4 Claims, 3 Drawing Figures

METHOD FOR SUPPLYING POWDER TO BE USED IN HOME SPRAY COATING OPERATION

BACKGROUND OF THE INVENTION

The present invention relates to a method for supplying powder to be used in a flame spray coating operation in which raw powder material (hereinafter described as powder material) is fed to a flame spray coating burner for carrying out a flame spray coating operation. That is to say, the present invention relates to a method of supplying powder material for flame spray coating which allows the rate at which the material is supplied to be easily controlled. The fuel gas and combustion supporting gas, which are directed to a burner for flame spray coating, also serve as: (1) jet gas of an ejector which acts as a carrier for supplying raw powder material to the burner; (2) suction gas which is introduced into a suction chamber of the ejector for regulating the rate at which powder is fed; and (3) gas which is directly introduced into the burner for spray coating without relation to the supply rate of raw material.

So-called spray coating operation with powder in which fine powdered metal, intermetallic compound or ceramics is heated to be formed in melting condition and is sprayed over base material to form an adherent coating has roughly been classified into two kinds of operations, that is, a flame spray coating operation and a plasma spray coating operation. The present invention, however, relates to an improvement on a method for supplying powder by making good use of an ejector employed in said flame spray coating operation.

In a conventional flame spray coating operation, it has broadly carried out control for the supply amount of powder due to a process for introducing the air into a suction chamber of an ejector in case of feeding powder material to a spray coating burner by means of an ejector. In other words, when the supply amount of powder is intended to be increased, the capacity of the air to be introduced into said suction chamber is decreased to lower down the internal pressure of said suction chamber so as to be able to transfer a large amount of powder into said suction chamber, while in case of the supply amount of powder being intended to be decreased, the capacity of the air to be introduced into the suction chamber is increased to raise up the internal pressure of the suction chamber so as to be able to decrease the supply amount of powder. Moreover, in the foregoing conventional method for supplying powder material, a large capacity of nitrogen contained in the air is mixed within flame so as to cause lowering down in the temperature of flame, moreover, oxygen contained in the air is also mixed within said flame to cause unstable balancing of combustion condition, in particular, said conventional method is not proper for flame spray coating operation with powder material such as ceramics (e.g. $Al_2O_3$) having a high melting point by using propane, methane, Hydrogen and the like as fuel gas.

SUMMARY OF THE INVENTION

The present invention eliminates the foregoing drawbacks in such conventional methods as mentioned above and provides a method, taking the foregoing defects into account, for supplying powder to be used in a flame spray coating operation in which control for the supply amount of powder material can readily be effected under the combustion condition of said flame spray coating burner being kept on constantly, in particular, is to provide an optimum method for supplying powder such as ceramics having a high melting point to be used in a flame spray coating operation, which is characterized by that fuel gas or combustion supporting gas in substitution for the air is introduced into the suction chamber of said ejector to serve as suction gas, and the supply amount of powder material to be fed to a spray coating burner is controlled with the aid of regulating the amount of suction gas thus introduced into said suction chamber.

BRIEF DESCRIPTION OF THE DRAWINGS

The present invention will now be described with reference to the drawings by way of example in a form of preferred embodiment of the invention.

DESCRIPTION OF THE PREFERRED EMBODIMENTS

Figure 1:
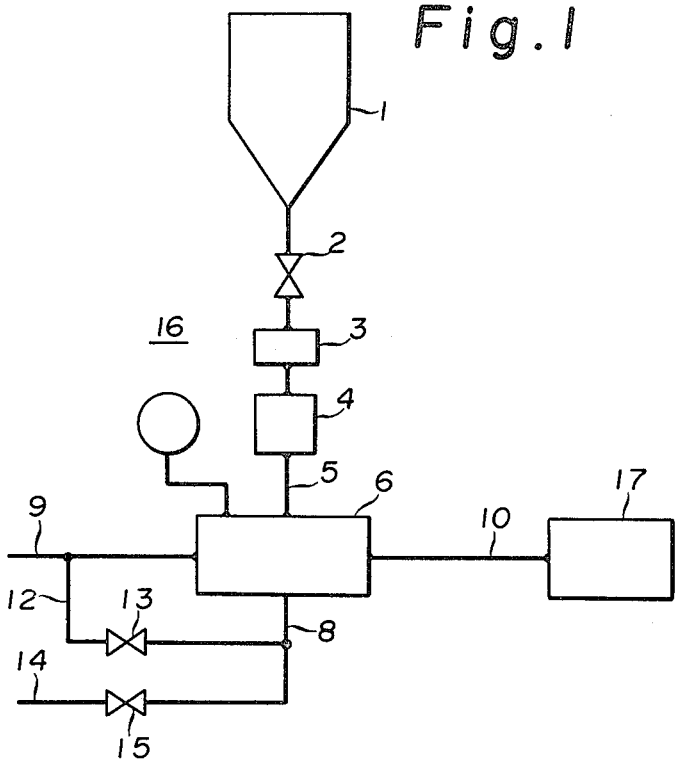
FIG. 1 is a block diagram of a first apparatus for supplying powder to be used in a flame spray coating operation applied to a method according to the present invention showing the set-up of said apparatus.
Figure 2:
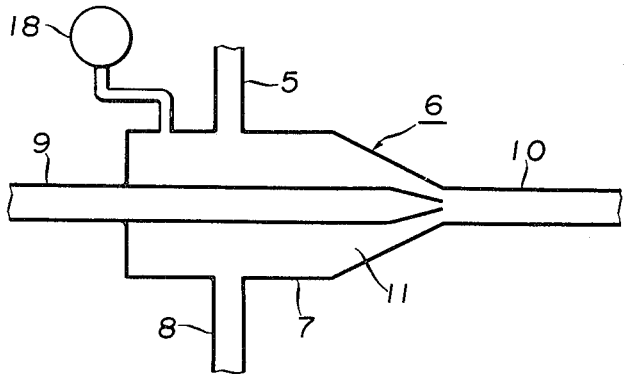
FIG. 2 is a block diagram of an ejector 6 illustrated in FIG. 1 showing the set-up of said ejector.

FIG. 1 is a block diagram of a first apparatus for supplying powder to be used in flame spray coating operation applied to a method according to the present invention, and in this drawing, powder material such as, for instance, alumina ($Al_2O_3$) and the like to be stored in a hopper 1 for storing said powder material is adapted to be introduced into a suction chamber formed in an ejector 6 through a stop valve 2 for said powder material, a controller 3 for regulating the flow amount said powder (for example, orifice), a flow meter 4 for powder and a conduit 5 in sequence. Said ejector 6 is set up in such a manner as is shown in FIG. 2 that said conduit 5 for supplying powder is fitted to the ejector 6 at the upper part of the outer wall 7 thereof and the other conduit 8 is fitted to said ejector 6 at the lower part of the outer wall 7 thereof, while an another conduit 9 having a tapered tip portion is inserted into said ejector 6 at the rear side of the outer wall 7 thereof in the direction of the convergent tip portion of said outer wall 7 whereto is fitted a still another conduit 10. Further, a suction chamber 11 is formed at an interspace between said conduit 9 and the outer wall 7, and said suction chamber 11 accommodates a pressure gauge 18 for said suction chamber to be fitted to the interior of said chamber. Now, back to FIG. 1 to continue the explanation on the set-up of said apparatus, jet gas for carrying the foregoing powder material is adapted to be introduced into the ejector 6 through said conduit 9. As for said jet gas, such kinds of gases are employed which include fuel gases, for instance, propane, propylene, butane, methane, ethane, acethylene, hydrogen and the like, or combustion supporting gases, for instance, oxygen, oxygen enriched gas and the like. However, in some cases, mixed gases containing compositions which are out of the range of explosive mixture of said fuel gases and combustion supporting gases may be used.

The foregoing jet gas diverges through a conduit 12 to be introduced into the suction chamber 11 of said ejector 6 to serve as suction gas passing through a gas regulating valve 13 and said conduit 8, further, said diverged gas to be fed to a conduit 14 is adapted to be introduced into the suction chamber 11 of the ejector 6 to serve as suction gas through a gas regulating valve 15 and said conduit 8. The foregoing suction gas is functional to adjust the internal pressure of the suction chamber 11 formed in said ejector 6 for regulating the supply amount of powder material to a desired optimum value, and said fuel gas or combustion supporting gas is used as this suction gas. In other words, in case of said fuel gas such as, for instance, acethylene, hydrogen and the like having high upper limit for explosive range being used as the foregoing jet gas, fuel gases of the same kind are selected to be used, while in case of fuel gases such as, for instance, propane and the like having low upper limit for explosive range being used as jet gas, fuel gases of the same kind or oxygen (combustion supporting gas) are selected to be used. However, in case of oxygen being used as jet gas, said oxygen is adapted to be employed as suction gas. Furthermore, in some cases, mixed gases containing such compositions as being out of the explosive range of fuel gas and combustion supporting gas may be able to serve as suction gas. Moreover, if said suction gas being identical with jet gas, said suction gas is fed to said suction chamber 11 passing through said diverging conduit 12 and said valve 13 for regulating gas flow rate, while said suction gas being different from said jet gas, said suction gas is fed into the suction chamber 11 through said conduit 14 and said valve 15 for regulating gas. In this instance, it goes without saying that said suction gas has to be fed in such a state as having compositions thereof after mixing is adjusted to the contents at the proportion to be out of the explosion range. The foregoing set-up of said constitutional members constructs an apparatus 16 for supplying powder to be used in flame spray coating operation from which gas-solid stream containing powder material and a mixture of jet gas with suction gas is adapted to be fed to a burner 17 for effecting flame spray coating operation through said conduit 10.

In the next place, explanation will now be given hereinafter on the operation of the apparatus formed according to the above-mentioned set-up with reference to FIGS. 1 and 2.

On one hand, powder material accumulated in the hopper 1 for storing said powder material is transferred to the suction chamber 11 formed within the ejector 6 passing through the powder material stop valve 2, the controller 3 for regulating the amount of powder, the flow meter 4 for powder and the conduit 5. On the other hand, jet gas is introduced into the ejector 6 through the conduit 9. Subsequently, since the conduit 9 being formed in a tapered shape at the tip portion thereof, said jet gas flowing through said conduit 9 is accelerated at the tapered tip portion and is exhausted therefrom toward the conduit 10. In consequence, ambient pressure around said conduit 9 at the tip portion thereof is lowered, so that powder material to be introduced through the conduit 5 is sucked to be gathered around the conduit 9 at the tapered tip portion thereof where said powder material thus sucked is mixed with jet gas to form in a gas-solid stream and is discharged into the conduit 10. In this instance, the supplying amount of powder material fed through the conduit 5 is determined dependent upon the internal pressure of the suction chamber 11 formed within the ejector 6 by setting the caliber of said controller 3 (an orifice) for regulating the amount of powder to be a constant dimension, and in case of said internal pressure of the suction chamber 11 being kept at a predetermined level, powder material is supplied to the ejector 6 at constant amount per unit hour at all times. Moreover, when the supply amount of powder material is desired to be varied and said suction gas is introduced into the suction chamber 11 passing through the conduit 12 and the gas regulating valve 13, the amount of introducing said suction gas is changed by means of said gas regulating valve 13 to fluctuate the internal pressure of the suction chamber 11, thus capable of fulfilling the foregoing desire for varying the supply amount of powder material. In other words, to decrease the supply rate of powder material the valve opening of said gas regulating valve 13 is enlarged to introduce suction gas at a large amount into the suction chamber 11 so as to increase the internal pressure of the suction chamber 11, thus causing lowering down in the supply amount of powder material. On the other hand, in case of intending increase in the supply amount of powder material, the supply amount of said powder material can inversely be increased by partially closing the valve opening of said gas regulating valve 13. It will be appreciated that the above operations can be performed while keeping the total supply of jet gas and suction gas at a constant value.

Figure 3:
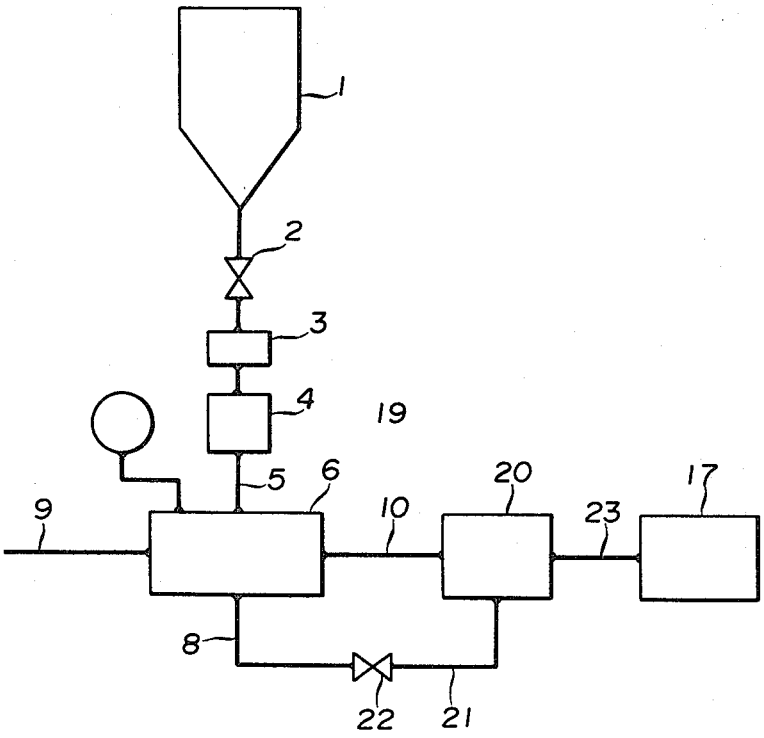
FIG. 3 is a block diagram of second apparatus for supplying powder to be used in flame spray coating operation applied to a method according to the present invention showing the set-up of said an other example apparatus.

Secondly, FIG. 3 is a block diagram of a second apparatus for supplying powder to be used in spray coating operation applied to a method according to the present invention showing the set-up of the apparatus, and said apparatus is characterized by such sequential steps of operation that gas carrying the foregoing powder material is partially separated from gas-solid stream by means of a gas-solid separator, said gas-solid stream having been discharged from an ejector, said gas thus separated is introduced into the suction chamber formed within the ejector so as to control the supply amount of said powder material which is adapted to be fed to the foregoing spray coating burner by regulating the amount of gas to be introduced into the suction chamber of said ejector.

In the above-identified drawing, powder material such as, for instance, alumina ($Al_2O_3$) and the like stored in the hopper 1 for accumulating powder material is adapted to be introduced into the suction chamber of the ejector 6 passing through the powder material stop valve 2, the controller (for example, orifice) 3 for regulating the amount of powder, the flow meter 4 for powder and the conduit 5 in sequence. Said ejector 6 is set up, as is shown in FIG. 2, with said conduit 5 for supplying powder fitted to said ejector 6 at the upper part of the outer wall 7 thereof and the conduit 8 also fitted to said outer wall 7 at the lower part thereof and the conduit 9 having the tapered tip portion inserted into said outer wall 7 at the rear side thereof along the tapered tip portion of said outer wall 7, and further with the conduit 10 fitted to said outer wall 7 at the tapered tip portion thereof, further, a suction chamber 11 is formed at an interspace between said conduit 9 and the outer wall 7, moreover, the pressure gauge 18 for the suction chamber is accommodated to be fitted within said suction chamber 11. Now, back to the elucidation again with reference to FIG. 3, said jet gas for carrying said powder material therewith is adapted to be introduced into the ejector 6. As for the foregoing jet gas, such kinds of gases are employed as fuel gases, for instance, propane, propylene, butane, methane, ethane, acethylene, hydrogen and the like, or combustion supporting gases, for instance, oxygen, oxygen enriched gas and the like. Said jet gas which is adapted to be introduced into the ejector 6 through said conduit 9 carries therewith powder material within the ejector 6 to be converted into gas-solid stream and further to be introduced into a separator 20 for separating gas and solid through the conduit 10. Said gas-solid separator 20 is a device which effects to separate a part of gas from said gas-solid stream and said gas thus separated by means of the separator 20 is adapted to be introduced into the suction chamber 11 of said ejector 6 passing through a conduit 21, an adjusting valve 22 for regulating return gas flow-rate and the conduit 8, while the most parts of gas-solid stream which are not yet separated are adapted to be exhausted into a conduit 23. The apparatus 19 for supplying powder to be used in flame spray coating operation has been set up according to the foregoing elucidation, and said gas-solid stream is introduced to the flame spray coating burner 17 from said apparatus 19 for supplying powder through the conduit 23, thus powder material is subjected to flame spray coating operation by means of said flame spray coating burner 17.

An explanation will be given hereinafter on the operation of the apparatus thus set up as mentioned above with reference to FIGS. 2 and 3.

Powder material reserved in the hopper 1 for powder material is, on one hand, introduced into the suction chamber 11 formed in the ejector 6 passing through the powder material stop valve 2, the controller 3 for regulating the amount of powder, the flow meter 4 for powder and the conduit 5. On the other hand, jet gas is introduced into the ejector 6 through the conduit 9. Then, since the conduit 9 is tapered at the tip portion thereof, jet gas is accelerated thereat to be discharged toward the conduit 10. In consequence, ambient pressure around said conduit 9 at the tapered tip portion is lowered, thus powder material adapted to be introduced through the conduit 5 is sucked to the area around the tapered tip portion of said conduit 9 and is mixed with said jet gas to be converted into gas-solid stream, further discharged toward the conduit 10. Said gas-solid stream thus passed through the conduit 10 is transferred to the gas-solid separator 20 wherein a part of the gas is separated from said gas-solid stream, and said gas thus separated is introduced into the suction chamber 11 of the ejector 6 passing through the conduit 21 and the control valve 22 for regulating return gas flow rate. Further, the most parts of said gas-solid stream thus introduced into the gas-solid separator 20 are introduced into the flame spray coating burner 17 passing through the conduit 23, thus are subjected to said flame spray coating operation by means of said above-identified burner 17.

Furthermore, the supply amount of powder material which is adapted to be fed into the ejector 6 through said conduit 5 is determined by the internal pressure of the suction chamber 11 formed within said ejector 6 due to adjustment for the caliber of the controller (orifice) 3 for regulating the amount of powder to a constant dimension, and when said internal pressure of said suction chamber 11 being kept at a constant level, powder material is fed to the ejector 6 at an equivalent amount per unit hour constantly. Moreover, in case of the supply amount of powder material being intended to be fluctuated, said intention of varying the supply amount of powder material can be fulfilled by changing the internal pressure of the suction chamber 11 formed within said ejector 6. Accordingly, for the sake of accomplishing the aforementioned intention, said apparatus is provided with the gas-solid separator 20, the conduit 21, the control valve 22 for regulating return gas flow rate and the conduit 8. In other words, when the supply amount of powder material being intended to be increased, said supply amount of powder material is increased with the aid of such steps of process to be taken that the opening of said control valve 22 for regulating return gas flow rate is diminished for decreasing the flow rate of gas which is separated by means of said gas-solid separator 20 and is adapted to be led into the suction chamber 11 of said ejector 6, whereby the internal pressure of the suction chamber 11 is lowered, thus resulting in increase of the supply amount of powder material. While, in case of the supply amount of powder material being intended to be decreased, the opening of said control valve 22 for regulating return gas flow rate is enlarged to raise the internal pressure of the suction chamber 11, thus resulting in decrease of the supply amount of powder material. The above-mentioned operation is carried out while detecting said powder material flow meter 4 or the pressure gauge 18 for the internal pressure of the suction chamber, thereby desired supply amount of powder material is able to be correctly obtained by adjusting the control valve 22 for regulating return gas flow rate. Still further, with previous detection for relationship between the opening of said control valve 22 for regulating return gas flow rate and the supply amount of powder material, the apparatus will be free from provision of powder flow meter 4 or the pressure gauge 18 for the internal pressure of the suction chamber therewith.

In the next place, the elucidation will be given hereinafter on the present invention method carried out by means of the foregoing first apparatus by way of example in a form of embodiment of the invention.

EXAMPLE 1

Powder of alumina ($Al_2O_3$) having 10 to 100 $\mu$m in diameter was employed as powder material. An orifice having 5 mm in diameter was used to serve as a controller 3 for regulating the amount of powder. Then propane was introduced into the ejector 6 by the capacity of 10 $Nm^3$/hr as fuel gas through the conduit 9. Oxygen was introduced into the suction chamber 11 of said ejector 6 through the conduit 14 and the spray coating burner 17 was ignited. Finally, the supply amount of alumina ($Al_2O_3$) could optionally be set to the value within the range of 10 to 40 kg/hr. Without disturbing the combustion state of said spray coating burner 17 under the control for the valve opening of said gas regulating valve 15.

EXAMPLE 2

Under the conditions same to the Example 1 mentioned above, said gas regulating valve 15 was closed, a part of propane introduced from the conduit 9 through the gas regulating valve 13 was transferred into the suction chamber 11 of the ejector 6. Subsequently, the spray coating burner 17 was ignited. Thereby the supply amount of alumina could optionally be set to the valve within the range of 5 l to 40 kg/hr. under the control for the opening of said gas regulating valve 13 (an adjusting valve) as well as the combustion state of the spray coating burner 17 being favorably free from being disturbed.

In the next place, the explanation will be made hereinafter on the foregoing second apparatus for carrying out the present inventive method by way of example in a form of embodiment of the invention.

EXAMPLE 3

Alumina ($Al_2O_3$) powder having 10 to 100 μm in diameter was employed as powder material, and an orifice having 5 mm in diameter was utilized as a controller 3 for regulating the amount of powder. Then, propane which was led from the conduit 9 by the capacity of 10 $Nm^3$/hr. was introduced into the ejector 6 and the spray coating burner 17 was ignited. Subsequently, at the fully opened stage of the valve opening of the control valve 22 for regulating return gas flow rate, the supply amount of alumina was figured out by 10 kg/hr., while at the fully closed stage of the valve opening was by 40 kg/hr., thus the supply amount of alumina could smoothly be fluctuated within the range of 10 to 40 kg/hr.

As set forth hereinbefore, the supply amount of powder material is adapted to be controlled by introducing fuel or combustion supporting gas into the suction chamber of the ejector and controlling the induced amount of said fuel gas or combustion supporting gas, and there is not the slightest fear of introducing in the ejector with such kinds of gases as air and the like which are apt to disturb the combustion state of the spray coating burner or lowering down the temperature of flame, whereby the supply amount of powder material is able to be set readily and extensively under constant and stable combustion state. Moreover, as the supply amount of powder material can be set by merely manipulating gas regulating valve 13, 15 or control valve 22 for regulating suction gas flow rate, the supply amount of powder material can be set far more easily as compared with the case, for example, of setting the supply amount of powder material due to the caliber of the controller (orifice) for regulating the amount of powder.

What is claimed is:

1. A method for supplying powder material to a flame spray coating burner by means of an ejector having a suction chamber therein, which comprises:

introducing a gas as jet gas into the ejector;

introducing powder material into the suction chamber, said jet gas drawing and carrying the powder material to form a gas-solid stream;

separating part of the gas from the gas-solid stream by means of a gas-solid separator;

introducing said part of said gas separated from the gas-solid stream into the suction chamber as suction gas;

controlling the rate of introduction of said suction gas into said suction chamber, thereby controlling the pressure in said suction chamber and the rate at which powder material is introduced therein; and conveying part of the gas-solid stream which is not separated to a flame spray coating burner while maintaining a combustion condition of said flame spray coating burner.

2. A method as described in claim 1 wherein said jet gas is fuel gas.

3. A method as described in claim 1 wherein said jet gas is a combustion supporting gas.

4. A method as described in claim 1 wherein said jet gas is a mixture of fuel gas and combustion supporting gas.

* * * * *

UNITED STATES PATENT AND TRADEMARK OFFICE

CERTIFICATE OF CORRECTION

PATENT NO. : 4,290,555

DATED : September 22, 1981

INVENTOR(S) : Toshio Suwa, et al

It is certified that error appears in the above—identified patent and that said Letters Patent is hereby corrected as shown below:

The title should be corrected to read

--METHOD FOR SUPPLYING POWDER TO BE USED IN FLAME SPRAY COATING OPERATION--

Column 6, line 66, delete "1".

Signed and Sealed this

*Twenty-fifth* Day of *May 1982*

[SEAL]

*Attest:*

GERALD J. MOSSINGHOFF

*Attesting Officer*

*Commissioner of Patents and Trademarks*